United States Patent [19]

Scott

[11] Patent Number: 4,833,738

[45] Date of Patent: May 30, 1989

[54] CONTROL VALVE ASSEMBLY FOR A CISTERN FLUSHING APPARATUS

[75] Inventor: Errol R. Scott, Transvaal, South Africa

[73] Assignee: Partall Systems (Proprietary) Limited, Transvaal, South Africa

[21] Appl. No.: 74,672

[22] Filed: Jul. 17, 1987

[30] Foreign Application Priority Data

Aug. 8, 1986 [ZA] South Africa ..... 86/5976

[51] Int. Cl.[4] ..... E03D 1/22

[52] U.S. Cl. ..... 4/324; 4/326; 4/407; 137/625.18; 251/321

[58] Field of Search ..... 137/606, 833, 625.18, 137/636; 251/321, 322–324; 4/406, 407, 408, 324–326; 74/479, 491, 543; 248/27.1; 200/5 A, 340

[56] References Cited

U.S. PATENT DOCUMENTS

| | | | |
|---|---|---|---|
| 2,800,664 | 7/1957 | Bridge | 4/407 |
| 3,088,122 | 5/1963 | Pore | 4/407 |
| 3,460,576 | 8/1969 | Allen | 251/321 |
| 3,466,674 | 9/1969 | Schroder | 4/407 |
| 3,789,862 | 2/1974 | Keller | 137/606 X |
| 3,918,105 | 11/1975 | Young | 4/326 |

FOREIGN PATENT DOCUMENTS

| | | | |
|---|---|---|---|
| 201268 | 8/1923 | United Kingdom | 251/321 |

*Primary Examiner*—Stephen Marcus

*Attorney, Agent, or Firm*—Birch, Stewart, Kolasch & Birch

[57] ABSTRACT

A dual push-button control valve assembly which can be mounted on the side wall of a cistern. The assembly includes a housing having an end which is passed outwardly through a hole in the wall of the cistern. Collars are threaded onto the end on opposite sides of the cistern wall to lock the assembly in place. The assembly also includes a cap which is clipped to the outer collar and which has openings receiving side-by-side push-buttons. Selective depression of the push-buttons results in actuation of the valve components situated within the housing and the supply of mains water through one of two outlet ports leading from the housing.

7 Claims, 3 Drawing Sheets

CONTROL VALVE ASSEMBLY FOR A CISTERN FLUSHING APPARATUS

BACKGROUND TO THE INVENTION

This invention relates to a control valve assembly for a cistern flushing apparatus.

In a co-pending patent application Ser. No. 07/074,672 filed simultaneously with the present invention by the same inventor, an invention is described in which different flushing volumes are attainable merely by depressing one or other of two buttons forming part of a control valve assembly which is mounted to the cistern wall.

One of the problems encountered by the inventor in the design of the system described in this copending Ser. No. 07/074,672 was the mounting of the control valve assembly to the cistern wall.

An object of the present invention is to provide a suitable mounting system for the control valve assembly.

SUMMARY OF THE INVENTION

According to the present invention, there is provided a control valve assembly for a cistern flushing apparatus, the control valve assembly being mountable on a wall of the cistern and comprising:

(a) a valve housing having an end which can be passed outwardly from inside the cistern through a hole in the wall of the cistern;

(b) a first abutment locatable on the outwardly passed end of the valve housing, the first abutment being oversize with respect to the hole in the wall of the cistern;

(c) a cap which can be clipped to the first abutment outside the housing;

(d) an opening in the cap;

(e) an externally, manually accessible push button receivable by the opening in the cap;

(f) valve components inside the valve housing which are actuable by depression of the push-button; and (g) a second abutment which is oversize with respect to the hole in the wall of the cistern and which is carried by the valve housing inside the cistern, one or both of the abutments being movable relative to the valve housing to sandwich the wall of the cistern between them and lock the control valve assembly to that wall.

According to a preferred feature of the invention, the end of the valve housing is threaded and in which both abutments are in the form of complementally threaded collars, the first abutment being threadable on an outwardly passed portion of the end and the second abutment being threadable on a portion of the end inside the cistern.

It is also preferred that the threaded collar forming the first abutment is peripherally grooved to take an O-ring and that the cap has a grooved skirt, the O-ring being receivable as a clip fit in the groove in the skirt.

There may be two openings side-by-side in the cap, two push-buttons are receivable by one of the openings and two sets of internal valve components in the valve housing which are selectively actuable by depression of one or other of the push-buttons.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF A PREFERRED EMBODIMENT

Figure 1:
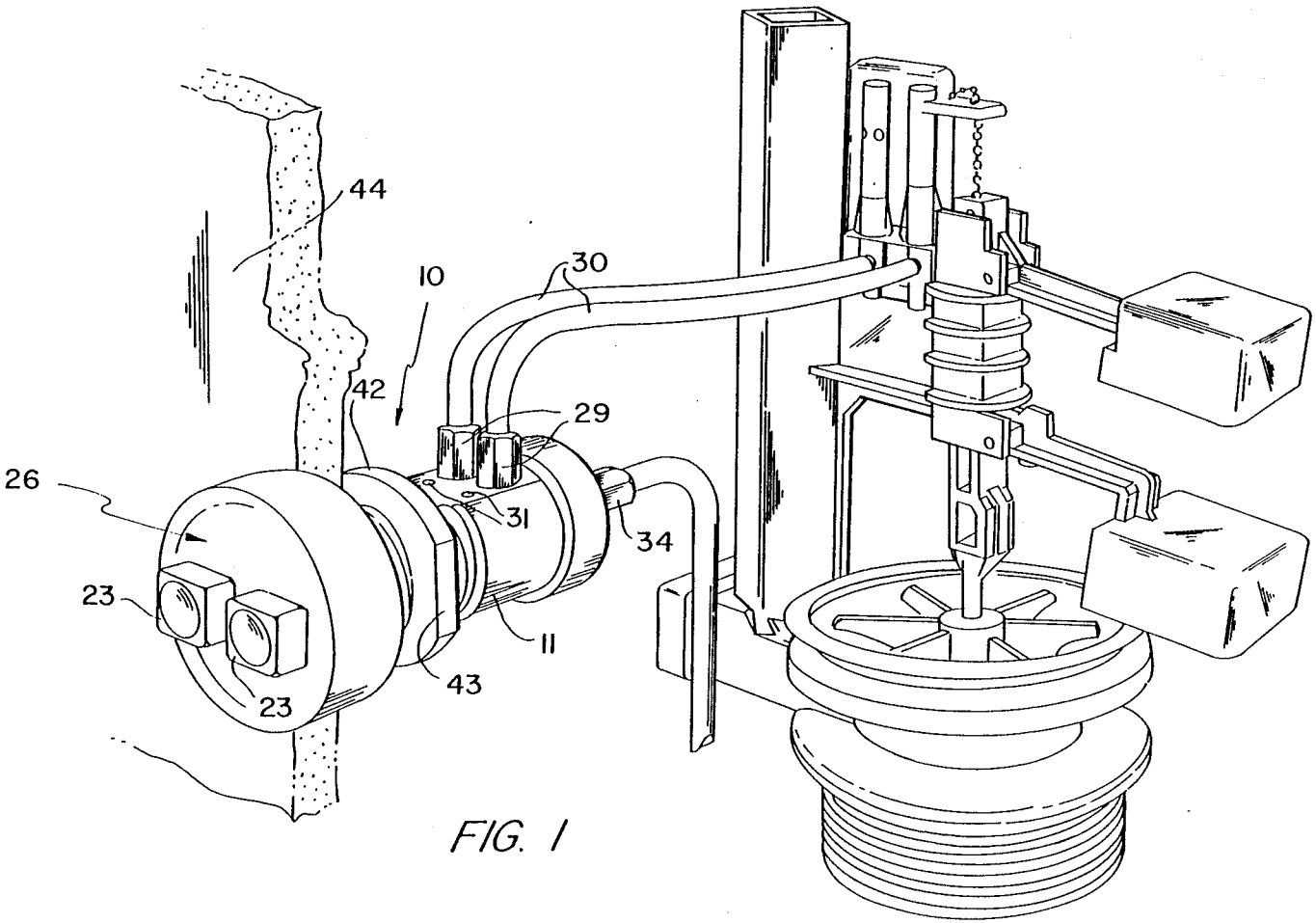
FIG. 1 shows a perspective view of a cistern flushing system which includes a control valve assembly mounted to the wall of a cistern according to the invention.
Figure 2:
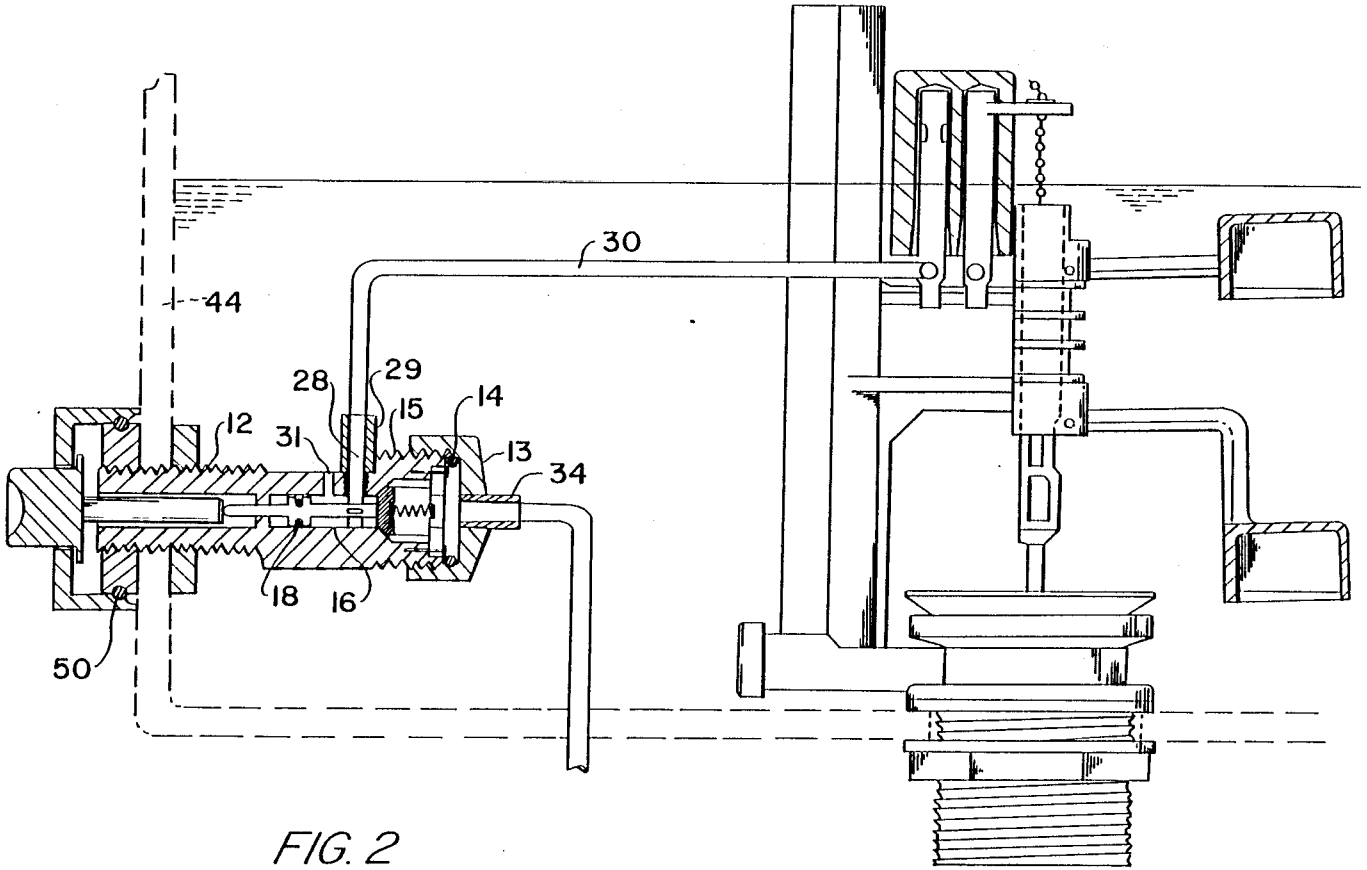
FIG. 2 shows a sectional view through the system of FIG. 1.

The illustrated cistern flushing apparatus and its operation is described in detail in the copending Ser. No. 07/074,672 referred to earlier. The present invention is specifically concerned with the control valve assembly of the system which is indicated with the reference numeral 10 in the Figures.

The assembly 10 has a housing 11 which has externally threaded ends 12 and 15. An internally threaded cap 13 is threaded onto the end 15 and is sealed with respect to the housing 11 by means of an O-ring seal 14. The interior of the housing 11 is formed with two parallel, spaced passages 16 which accommodate slidable plungers 17 and which open at one end into a chamber 33 and at the other end into coaxial passages 21 formed in the threaded end 12 of the housing 11.

Each plunger 17 has an enlarged central region which is grooved to take an O-ring 18 which makes sealing contact with the wall of the passage 16 during sliding of the plunger 17. Compression springs 20 act between the cap 13 and a conically shaped sealing element 36 carried at the end of each plunger 17. Under the bias of the spring force, the sealing elements 36 seat on conical valve seats 35 at the end of the passages 16 where they enter the chamber 33.

Each plunger 17 has a portion, at its end opposite from that carrying the sealing element 36, which protrudes into a passage 21. The passage 21 accommodates an extension 22 of an actuating button 23, of which two are provided, one for each plunger 17.

The buttons 23 are square in shape and are located side-by-side. They protrude through a cap 26 formed with appropriately dimensioned square holes for receiving the buttons. The cap 26 has a round cylindrical wall 41 which is formed with a groove 50 near to its free edge.

Figure 3:
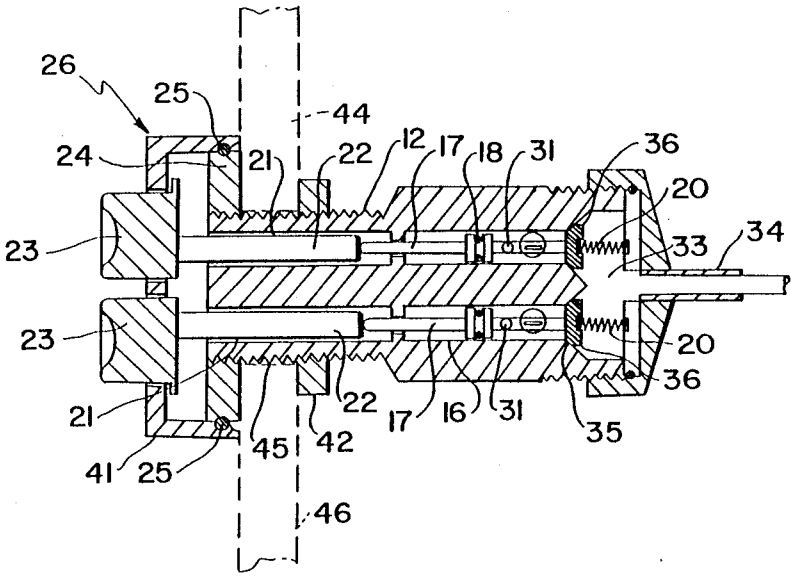
FIG. 3 shows a sectional view through the control valve assembly, the section being taken at right angles to the section of FIG. 2.

Threaded onto the end 12 of the housing 11 there is a collar 24 which has a groove at its periphery in which an O-ring 25 is located. There is another collar 42, formed with opposing flats 43, threaded onto the end 12. When assembled, the cap 26 is mated with the collar 24 in a clip fit with its groove 50 receiving the O-ring 25. As shown in FIG. 3, the control valve assembly 10 of the cistern flushing system is fitted to an upstanding wall 44 of a cistern. This is achieved by unclipping the cap 26 from the collar 24, removing the collar 24 from the threaded end 12, feeding the threaded end outwardly through a hole 45 in the cistern wall 44, threading the collar 24 onto the threaded end 12 outside the cistern wall, and clipping home the cap 26 with the buttons 23 received through its square holes so as to be readily accessible from outside the cistern. An appropriate spanner is applied to the flats of the collar 42 which is tightened up against the interior surface 46 of the cistern wall to secure the control assembly in position.

Intersecting each passage 16 are spaced ports 28 and 31. Each port 28 has a nipple 29 connected to it, while the port 31, which is a bleed port, merely extends to the periphery of the housing 11. Flexible hoses 30 are connected up to the nipples 29.

A further nipple 34 is connected up to an axial port 32 extending through the cap 13 and communicating with the chamber 33. A conduit connected to the water mains is connected up to the nipple 34.

The control assembly 10 is used to supply water at mains pressure selectively through one or the other of the hoses 30, the reason for this being explained in detail in the copending application referred to earlier.

This is achieved by depressing a selected one of the buttons 23. When a button 23 is depressed, the relevant plunger 17 is moved axially against the spring bias to a position in which the sealing element 36 which it carries is spaced from the seat 35, thereby allowing mains pressure water to flow through the relevant passage 16 and outwardly into the relevant hose 30 via the port 28. Full depression of the button 23 only moves the plunger 17 far enough for the O-ring 18 to be located between the ports 28 and 31, so that the mains water which is admitted to the passage 16 cannot escape via the bleed port 31. The function of the bleed port is also described in more detail in copending Ser. No. 07/074,672 referred to earlier.

I claim:

1. A control valve assembly for a cistern flushing apparatus, the assembly comprising:

(a) a single valve housing locatable inside the cistern and having a first, threaded end dimensioned to pass outwardly through a hole in the wall of the cistern;

(b) a first collar threadable on the first end of the valve housing inside the cistern;

(c) a second collar threadable onto the first end of the valve housing outside the cistern, the first and second collars being oversized with respect to the hole in the wall of the cistern and being movable relative to one another on the first end of the valve housing to sandwich the wall of the cistern between them and secure the valve housing to that wall;

(d) a cap for mounting on said second collar;

(e) retaining means mounted on said second collar and said cap for retaining said cap and second collar relative to each other;

(f) a pair of liquid flow passages each extending in the valve housing between an inlet and an outlet;

(g) valve means for each passage, the valve means being independently actuable to control liquid flow through the passages from inlet to outlet; and (h) a pair of push-buttons each of which is associated with one of the valve mans;

(i) said cap being clipped to the second collar outside the housing by engaging said retaining means on said second collar and said cap for mounting the push-buttons to protrude outwardly in side-by-side relationship through the cap for providing external, manually accessible push-buttons being selectively depressible to actuate a selective valve means.

2. The control valve assembly of claim 1, wherein the retaining means includes a peripherally grooved second collar for receiving an O-ring and in which the cap has a grooved skirt, the O-ring being receivable as a clip fit in the groove in the skirt.

3. The control valve assembly according to claim 1, wherein the push-buttons are rectangular and extend outwardly through rectangular, side-by-side openings in the cap.

4. The control valve according to claim 1, wherein said valve means for each passage each includes a sealing element biased to a position to normally close the liquid flow passages and each includes a slidable plunger operatively connected to said sealing element, each said push-buttons being engageable with one of said slidable plungers for selectively actuating individual slidable plungers for permitting communication of fluid through one of said liquid flow passages.

5. The control valve according to claim 4, wherein a spring is provided for biasing said sealing elements to a normally closed position.

6. The control valve according to claim 1, and further including a mounting cap being disposed on said single valve housing at a position displaced from said threaded end for permitting access to the interior of said valve housing.

7. The control valve according to claim 4, and further including O-rings being operatively mounted on each of said slidable plungers for providing a fluid tight seal within each of said liquid flow passages.

* * * * *